United States Patent [19]

Payet

[11] 4,067,688

[45] * Jan. 10, 1978

[54] DURABLE PRESS PROCESS FOR CELLULOSIC FIBER-CONTAINING FABRICS UTILIZING FORMALDEHYDE AND AN ARYL SULFONIC LIQUID OR ACID CATALYST

[75] Inventor: George Louis Payet, Cincinnati, Ohio

[73] Assignee: The Strike Corporation, Cincinnati, Ohio

[ * ] Notice: The portion of the term of this patent subsequent to June 1, 1993, has been disclaimed.

[21] Appl. No.: 676,815

[22] Filed: Apr. 14, 1976

Related U.S. Application Data

[63] Continuation-in-part of Ser. No. 486,168, July 5, 1974, Pat. No. 3,960,482, and a continuation-in-part of Ser. No. 524,770, Nov. 18, 1974, Pat. No. 3,960,483.

[51] Int. Cl.[2] ..... D06B 1/00; D06M 1/14

[52] U.S. Cl. ..... 8/116.4; 8/115.6; 8/116 R; 427/336; 427/339

[58] Field of Search ..... 8/116.4, 115.6, 116 VM, 8/116 V, 116 H; 427/336, 439

[56] References Cited

U.S. PATENT DOCUMENTS

| | | | |
|---|---|---|---|
| 2,311,080 | 2/1943 | Pinkey | 8/116.4 |
| 2,870,041 | 11/1959 | Waddle et al. | 8/186 |
| 3,138,802 | 6/1964 | Getchell | 427/342 |
| 3,186,954 | 6/1965 | Hushebeck | 8/116.4 |
| 3,264,054 | 9/1966 | Reinhardt et al. | 8/116 V |
| 3,472,606 | 10/1969 | Getchell et al. | 8/116 M |
| 3,837,799 | 9/1974 | Wilson et al. | 8/115.6 |
| 3,960,482 | 6/1976 | Payet | 8/116.4 |
| 3,960,483 | 6/1976 | Payet | 8/116.4 |

*Primary Examiner*—Joseph L. Schofer
*Assistant Examiner*—Maria S. Tungol
*Attorney, Agent, or Firm*—Bacon & Thomas

[57] ABSTRACT

The present invention relates to a durable press process for cellulosic fiber-containing fabrics which utilizes formaldehyde and an aryl sulfonic acid catalyst to impart wrinkle resistance to the fabric.

12 Claims, No Drawings

DURABLE PRESS PROCESS FOR CELLULOSIC FIBER-CONTAINING FABRICS UTILIZING FORMALDEHYDE AND AN ARYL SULFONIC LIQUID OR ACID CATALYST

CROSS REFERENCE TO RELATED APPLICATION

This application is a continuation-in-part of my copending application Ser. No. 486,168, filed July 5, 1974, now Pat. No. 3,960,482 for a Durable Press Process and is also continuation-in-part of my copending application Ser. No. 524,770 filed Nov. 18, 1974, now U.S. Patent No. 3,960,483 also for a Durable Press Process.

BACKGROUND OF THE INVENTION

1. Field of the Invention:

This invention relates to a durable press process for cellulosic fiber-containing fabrics and more particularly to a process which utilizes formaldehyde and a catalyst to impart wrinkle resistance to cellulosic fiber-containing fabrics.

There have been a great many proposed processes in recent years for treating cellulosic fiber-containing products, such as cloth made of cotton or cotton blends, with formaldehyde to provide durable cross-linking of the cellulosic molecules and to thereby impart durable crease resistance and smooth drying characteristics to the goods. However, problems have been encountered, and although a number of the processes have been operated commercially there is a great need for improvement.

As pointed out in U.S. Pat. No. 3,706,526, granted Dec. 19, 1972, the processes have tended to lack reproducibility, since control of the formaldehyde cross-linking reaction has been difficult. The process of this patent is said to solve the control problem by controlling moisture present in the cellulosic material during the reaction. The cellulosic material is conditioned to give to a moisture content of between about 4 to 20%, preferably 5 to 12%, based on the dry weight of the cellulose fiber, and it is then introduced into a gaseous atmosphere containing water vapor, a cellulose cross-linking amount of formaldehyde (e.g. 15 to 60 volume percent) and a catalytic amount of sulfur dioxide.

Canadian Pat. No. 897,363, granted Apr. 11, 1972, discloses a process for the formaldehyde cure of cellulosic fibers which comprises applying to the cellulosic material, a solution of zinc chloride, ammonium chloride, phosphoric acid or zinc nitrate, conditioning the fabric to a moisture content of between about 7 and 15 based on the dry weight of the fabric, and thereafter exposing the catalyst-containing fabric or article made therefrom to an atmosphere of formaldehyde or formaldehyde vapor (5 to 75% volume percent) at a temperature of between about 90° and 150° C.

The process requires precise moisture control and is said to be limited to the use of the few select catlysts.

Accordingly, a need exists for a simple and economical durable press process which does not depend on precise moisture control to moderate the cross-linking and does not require high concentrations of formaldehyde.

SUMMARY OF THE INVENTION

The present invention takes advantage of the observation that the cross-linking of cellulosic fibers with formaldehyde vapors takes place most readily when the fibers are in a moisture swollen condition. This is accomplished by introducing the fibers into a formaldehyde vapor treating chamber while they contain over 20% by weight of moisture, based on the dry weight of the fibers and, preferably, when over 60% by weight of moisture is present. Under these conditions the concentration of formaldehyde in the vapor treating chamber and amount of formaldehyde added can be kept to a minimum. Control of the reaction is accomplished by impregnating the cellulosic material with that amount of a catalyst which will produce the desired amount of cross-linking under the curing conditions used.

One object of this invention is to provide a durable press process which produces fabrics having high crease retention and excellent wash appearance with acceptable tensile strength.

Another object of the invention is to provide a formaldehyde vapor treating process in which the formaldehyde concentration in the vapor treating chamber can be kept at a low value, thereby reducing explosion and fire hazards.

Yet another object is to provide a durable press treatment process which requires a relatively small amount of formaldehyde thereby significantly reducing the amount of excess formaldehyde found on the garment after treatment and thus substantially reducing the washing and steam cleaning required by the known processes.

Still another object of the invention is to provide a durable press process which enables the control of the catalysts present and avoids limitation upon use of water as the moderator of the reaction.

DETAILED DESCRIPTION OF THE INVENTION

The process of the invention comprises increasing the moisture content of a cellulosic fiber-containing fabric to above 20% by weight so that the fibers are substantially completely swollen in the presence of a catalyst and then introducing the fabric into formaldehyde vapors in a treating chamber and curing to improve the wrinkle resistance of the fabric. The fabric may be impregnated with an aqueous solution of the catalyst and then treated with formaldehyde vapors.

The invention does not use limited amounts of moisture to control the cross-linking reaction since the cross-linking reaction is most efficient in the most highly swollen state of the cellulose fiber. The relatively high amount of water present allows more efficient conversion of formaldehyde to the hydrate which is the cross-linker. Thus, optimum results can be obtained with much less formaldehyde.

During the cross-linking reaciton at the curing stage, moisture is given up from the fabric as the cross-linking occurs, resulting in a decrease in the moisture content of the fabric. In fabrics having a moisture content of 20% or less, this tends to lower the effectiveness of the cross-linking reaction requiring higher concentrations of formaldehyde. In the process of the present invention, moisture is given up from a high level, that is, greater than 20% preferably greater than 30%, e.g., from 60–100% or more, and the cross-linking is optimized. Moisture which is so difficult to control, is not a problem in the present invention which only requires that the moisture content be above 20% which is simple to insure. Of course, water is not allowed to be present in so much of an excess as to cause the catalyst to migrate on the fabric.

The necessary moisture may be applied to the fabric by any conventional technique. It may be added separately or in the form of an aqueous solution of the selected catalyst, as by padding, fogging, spraying or the like. A fog spray will achieve high moisture content in a very short time. In addition, water spray or fog insures uniform moisturization.

In the present process, the amount of catalyst used controls the cross-linking. Preferably, an aqueous solution of the catalyst is padded onto the fabric so as to supply both the catalyst and the moisture in one operation. Of course, a spray technique could also be used.

As disclosed in copending application Ser. No. 524,770, alkylsulfonic acid catalysts may be used in the high moisture process since the cross-linking is optimized by the high moisture content and fully swollen condition of the fibers. While alkylsulfonic acids such as ethanesulfonic acid, give good results with acceptable whiteness, it has now been found that para-toluenesulfonic acid produces a fabric which is considerably whiter. Thus, the present invention relates to the use of arylsulfonic acids as catalysts in the high moisture content process. The arylsulfonic acid catalyst which is used is first dissolved in an aqueous solution and then applied to the fabric which is then treated with formaldehyde vapor to effect cross-linking.

The water soluble arylsulfonic acids which may be used as catalysts in the process of the present invention included toluene sulfonic acid, benzene sulfonic acid, naphthalene sulfonic acid and the halogen, hydroxy and nitro derivatives of these compounds, para-toluene sulfonic acid being particularly preferred.

For example, 4-chlorobenzene sulfonic acid, 3, 4 diamino benzene sulfonic acid, 4-ethyl-amino benzene sulfonic acid, 5-nitro toluene sulfonic acid, 8-hydroxynaphthalene sulfonic acid, 2-Naphthalene-5-nitroso-6-hydroxy sulfonic acid and 2-naphthalene-6-hydroxy sulfonic acid may be used.

The amount of catalyst may vary depending upon the particular type and the desired characteristic of the final fabric. However, in general the catalyst is incorporated in the fabric, on a dry weight basis, in an amount within the range of from 0.1% to about 10%, preferably about 0.1 to 1%.

The catalyst may be applied to the fabric from an aqueous solution by conventional techniques, preferably such as padding or spraying. The pH of the aqueous solution is of course in the acid range. Padding is the preferred method of application since the amount of solution applied can be carefully controlled.

The fabric may be continuously precured by first applying the aqueous catalyst solution to the fabric, adding additional moisture if necessary, and then exposing the fabric to formaldehyde vapors.

The concentration of the catalyst solution may be such as to supply with the catalyst that amount of water necessary to fully swell the cellulose fibers without further addition to moisture. Exposure to the formaldehyde vapors in this case is usually substantially immediately after the catalyst is applied to the fabric. Only two process steps are necessary, application of catalyst solution and treatment with formaldehyde vapors at the proper curing temperature. Of course, the fabric may be first formed into a garment and then impregnated with an aqueous solution of the acid catalyst followed by exposure to formaldehyde vapors. Again, the aqueous catalyst solution must contain sufficient water to fully swell the cellulose fibers or moisture must be added.

As indicated, the high moisture content in the fabric fully swells the cellulose fibers and optimizes the cross-linking reaction thereby providing improved crease resistance. Accordingly, considerably less formaldehyde is required than in the known vapor processes. This results in a direct reduction in the cost of the process. Moreover, due to the lower concentration of formaldehyde required, less excess formaldehyde is found on the fabric after treatment and the extent to which washing or steam cleaning is required is minimized.

The formaldehyde concentration in the treatment chamber is from about 1.0% to about 6.5% by volume, preferably about 1.0% to 3.0%. The dry add-on by reaction of the formaldehyde with the fabric at this concentration is generally less than about 0.5%. At concentrations of formaldehyde below about 1% by volume in the treatment chamber the wash appearance and crease resistance become less satisfactory than desired. At concentrations of much above about 3% there is usually no significant increase in these properties.

The utilization of small concentrations of formaldehyde in the treating chamber significantly reduces the fire hazard presented by formaldehyde since formaldehyde tends to be explosive in concentrations of 7% by volume or above when mixed with air.

The curing temperature at which the final cross-linking takes place is in the range of from about 200° F. to about 250° F., preferably about 212° F. to 245° F. Advantageously, it should be at least about 230° F. to insure that there is sufficient cross-linking to provide the necessary wrinkle resistance in the fabric. While higher temperatures may be used, they detract from the economics of the system. Temperatures above 325° F., as conventionally employed in resin curing, do not improve the present process and may serve to degrade the fabric by the action of the catalyst. The formaldehyde treatment and curing may take place in the same treating chamber or in separate chambers or zones of the treating apparatus.

It is sometimes desirable, depending upon the desired characteristic of the fabric, to add to the fabric a polymeric resinous additive that is capable of forming a soft film. For example, such additives may be a latex or fine aqueous dispersion of polyethylene, various alkyl acrylate polymers, acrylonitrilebutadiene copolymers, deacetylated ethylene - vinyl acetate copolymers, polyurethanes and the like.

Such additives are well known to the art and generally commercially available in concentrated aqueous latex form. For use in the process of this invention, such a latex is diluted to provide about 1% to 3% polymer solids in the aqueous catalyst-containing padding bath before the fabric is treated therewith. However, it is not necessary or desirable to add monomers or formaldehyde binding agents.

As the cellulosic fiber-containing fabric which may be treated by the present process there can be employed various natural or artificial cellulosic fibers and mixtures thereof, such as cotton, linen, hemp, jute, ramie, sisal, rayons, e.g., regenerated cellulose (both viscose and cuprammonium). Other fibers which may be used in blends with one or more of the above-mentioned cellulosic fibers are, for example, polyamides (e.g., nylons), polyesters, acrylics (e.g., polyacrylonitrile), polyolefins, polyvinyl chloride, and polyvinylidene chloride. Such blends preferably include at least 35% to 40% by weight, and most preferably at least 50% to 60% by weight, of cotton or natural callulose fibers.

The fabric may be a resinated material but preferably it is unresinated; it may be knit, woven, non-woven, or otherwise constructed. It may be flat, creased, pleated, hemmed, or shaped prior to contact with the formaldehyde containing atmosphere. After processing, the formed crease-proof fabric will maintain the desired configuration substantially for the life of the article. In addition, the article will have an excellent wash appearance even after repeated washings.

The equipment necessary to carry out the process is very much simplified since moisture control is not used as the moderator for the reaction. The aqueous, acid catalyst may be applied by padding or spraying. Moisturization of the fabric, if additional moisture is necessary, may be carried out by passing the fabric through a fog of water before entering the reaction chamber. The fabric containing the latent catalyst may then be placed in a reaction chamber to which gaseous formaldehyde is supplied from any convenient source, e.g., a formaldehyde generator wherein formaldehyde vapor is produced by heating para-formaldehyde. The formaldhyde vapors are diluted with air or other gas to provide the desired concentration. Preferably, the formaldehyde is generated outside the chamber containing the fabric to reduce the fire hazard.

The reaction chamber is preferably one which can be heated to a sufficiently high temperature to insure that the cross-linking reaction takes place. The atmosphere in the reaction chamber is preferably a mixture containing from 1% to 6.5% formaldehyde gas by volume, diluted with air or an inert gas such as nitrogen. Higher concentrations of formaldehyde could be used but are not required by this process.

To contact the fabric with formaldehyde vapors any suitable means may be employed. For example a batch system utilizing a closed vessel or tube containing the gaseous formaldehyde or into which formaldehyde is introduced may be used. The catalyst-containing fabric may be placed in the treating vessel for the appropriate time. In the alternative, a dynamic or continuous system can be used such as one wherein a stream of formaldehyde vapor is passed through a closed elongated chamber through which the fabric is also passed at an appropriate rate, either concurrently or countercurrently relative to the formaldehyde vapor or gas mix. It is also possible to use combinations of the above, such as by passing a stream of formaldehyde containing gas over a stationary fabric.

Having generally described this invention, a further understanding can be obtained by reference to certain specific examples which are provided herein for purposes of illustration only and are not intended to be limiting unless otherwise specified.

EXAMPLE 1

The fabric was a 50/50 polyester cotton sheeting which was padded with an aqueous para-toulene sulfonic acid catalyst solution containing the amount of catalyst as indicated in the following Table 1 to provide about 100% pick-up. The amount of catalyst shown in Table 1 is solution concentration, which at 100% pick-up of solution by the fabric also corresponds to the amount of catalyst by weight incorporated into the fabric based on the dry weight of the fabric. In addition to the specified amount of catalyst, the catalyst solution contained 0.2% Triton X-100 wetting agent. The cellulose fibers of the cloth at the 100% pick-up of solution were swollen to their maximum extent. The samples, without drying, were then placed in a heating chamber into which vapors from an amount (about 10 grams) of paraformaldehyde calculated to provide about 3.06% by volume of formaldehyde were introduced. The samples were exposed to the formaldehyde vapors for several mintues at about 100° F. and were then heated to about 245° F. in the chamber atmosphere.

The samples were then removed from the chamber, washed and dried. The crease resistance (Wrinkle Recovery) was determined by A.A.T.C.C. Test Method 66-1968. All samples were very white in appearance. The results are set forth in Table 1.

TABLE 1

| Sample No. | p-Toluene Sulfonic Acid | Crease Recovery Angle Dry Warp | Dry Filling | Dry W & F | Wet Warp | Wet Filling | Wet W & F |
|---|---|---|---|---|---|---|---|
| 1 | 0.2 | 143.3 | 145.7 | 289.0 | 156.0 | 155.7 | 311.7 |
| 2 | 0.3 | 150.0 | 150.7 | 300.7 | 159.0 | 157.7 | 316.7 |
| 3 | 0.4 | 151.7 | 152.3 | 304.0 | 157.3 | 156.3 | 313.6 |
| 4 | 0.5 | 150.3 | 151.0 | 301.3 | 155.7 | 154.7 | 310.4 |

As can be seen from the table, excellent crease resistance were obtained. A crease resistance of 290 is considered good by current standards in the industry.

I claim:

1. A durable press process for cellulosic fiber-containing fabrics, comprising: impregnating a cellulosic fiber-containing fabric with an aqueous solution containing a water soluble arylsulfonic acid which is capable of catalyzing the cross-linking reaction between formaldehyde and cellulose; to provide from 0.1% to about 10% of said catalyst in said fabric on a dry weight basis, then exposing said impregnated fabric, while said fabric has a moisture content of above 20% by weight where the cellulose fibers are substantially completely swollen, to formaldehyde vapors and curing under conditions at which formaldehyde reacts with cellulose in the presence of the catalyst to improve the wrinkle resistance of the fabric.

2. The process of claim 1, wherein the catalyst is a water soluble acid selected from the group consisting of toluene sulfonic acid, benzene sulfonic acid, naphthalene sulfonic acid and halogen, hydroxy, and nitro derivatives thereof.

3. The process of claim 2, wherein the catalyst is toluene sulfonic acid.

4. The process of claim 1, wherein the moisture content of the fabric at the time of exposure to formaldehyde is above about 30% by weight.

5. The process of claim 1, wherein the fabric is cotton.

6. The process of claim 1, wherein the fabric is a cotton polyester blend.

7. The process of claim 1, wherein the temperature during the cross-linking reaction is in the range of about 212° F. to about 245° F.

8. The process of claim 1, wherein the fabric is exposed to an atmosphere containing no more than about 6.5% formaldehyde.

9. The process of claim 1, wherein the fabric is exposed to an atmosphere containing from about 1.0% to 3.0% by volume of formaldehyde.

10. The process of claim 1, wherein the fabric is a resinated material.

11. The process of claim 4, wherein the fabric is exposed to an atmosphere containing about 6.0% by volume of formaldehyde.

12. The process of claim 1, wherein the fabric contains from about 0.1% to about 1% by weight of said catalyst.

* * * * *